US011127388B2

(12) United States Patent
Trombley

(10) Patent No.: US 11,127,388 B2
(45) Date of Patent: Sep. 21, 2021

(54) ACOUSTIC CYMBAL DAMPER FOR MUSICAL PERFORMANCE

(71) Applicant: Trombley Industries, LLC, Castle Rock, CO (US)

(72) Inventor: Benjamin Trombley, Castle Rock, CO (US)

(73) Assignee: TROMBLEY INDUSTRIES, LLC, Castle Rock, CO (US)

( * ) Notice: Subject to any disclaimer, the term of this patent is extended or adjusted under 35 U.S.C. 154(b) by 0 days.

(21) Appl. No.: 16/559,079

(22) Filed: Sep. 3, 2019

(65) Prior Publication Data

US 2020/0227019 A1 Jul. 16, 2020

Related U.S. Application Data

(60) Provisional application No. 62/616,069, filed on Jan. 11, 2018.

(30) Foreign Application Priority Data

Jan. 10, 2019 (WO) ..... PCT/US2019/013031

(51) Int. Cl.
*G10K 11/162* (2006.01)
*G10D 13/065* (2020.01)

(52) U.S. Cl.
CPC ..... *G10K 11/162* (2013.01); *G10D 13/065* (2013.01)

(58) Field of Classification Search
CPC ..... G10K 11/162; G10D 13/065
USPC ..... 84/422.3
See application file for complete search history.

(56) References Cited

U.S. PATENT DOCUMENTS

| | | | | |
|---|---|---|---|---|
| D86,705 | S | 4/1932 | Dopyera | |
| 3,141,370 | A * | 7/1964 | Ross | G10D 13/06 84/402 |
| D216,441 | S | 1/1970 | Ross | |
| 4,028,984 | A | 6/1977 | Sanchez | |
| D339,818 | S | 9/1993 | Peterson | |

(Continued)

FOREIGN PATENT DOCUMENTS

| | | | |
|---|---|---|---|
| JP | H02187792 | A | 7/1990 |
| WO | 2010/044651 | A2 | 4/2010 |

OTHER PUBLICATIONS

Amazon, RockSolid Drum practice Pad, posted Feb. 1, 2012, [online], [visited Jun. 28, 2019]. Internet, URL: https://www.amazon.co.uk/Drum-Kit-Silencer-Practice-Pads/dp/B0074A9O4W/ref=olp_product_details?_encoding=UTF8&me= (Year: 2012).

(Continued)

*Primary Examiner* — Jianchun Qin
(74) *Attorney, Agent, or Firm* — Loza & Loza, LLP; Gordon R. Lindeen, III

(57) ABSTRACT

An acoustic damper system is described that is suitable for musical performances. In one example, a musical instrument is carried on a stand. A fixture is configured to be attached to the musical instrument stand and one or more fingers extend away from the fixture and the musical instrument stand to contact the musical instrument, such as a cymbal. An acoustic shield can also be attached to the musical instrument stand that has a side wall surrounding a portion of the edge of the musical instrument to reflect sound back toward the musical instrument.

20 Claims, 11 Drawing Sheets

(56) References Cited

U.S. PATENT DOCUMENTS

| | | | | |
|---|---|---|---|---|
| 5,400,685 | A * | 3/1995 | Cappella | G10D 13/12 84/422.4 |
| 5,918,300 | A | 6/1999 | Hsieh | |
| 5,959,227 | A * | 9/1999 | Shapiro | G10D 13/06 84/411 M |
| D473,053 | S | 4/2003 | Spitler | |
| 6,720,491 | B1 * | 4/2004 | Kroncke | G10D 13/06 84/422.3 |
| D597,589 | S | 8/2009 | Onishi | |
| D741,149 | S | 10/2015 | Koop et al. | |
| D763,953 | S | 8/2016 | Kenkman | |
| 2003/0233928 | A1 * | 12/2003 | Gatzen | G10D 13/02 84/411 M |
| 2013/0255471 | A1 | 10/2013 | Prefontaine | |
| 2014/0083276 | A1 * | 3/2014 | Yoshino | G10K 11/002 84/422.1 |
| 2016/0210945 | A1 | 7/2016 | Tanabe | |

OTHER PUBLICATIONS

Youtube, The Cymbal Shield promo, posted Mar. 27, 2017, [online], [visited Jun. 28, 2019]. Internet, URL: https://www.youtube.com/watch?v=80ZeTjQAEYI (Year: 2017).

PCT International Search Report with attached Written Opinion of the International Searching Authority for International Application No. PCT/US2019/013031, dated Apr. 22, 2019, 13 pages.

* cited by examiner

ACOUSTIC CYMBAL DAMPER FOR MUSICAL PERFORMANCE

CROSS-REFERENCE TO RELATED APPLICATIONS

The present application claims the priority of International Application Number PCT/US2019/013031 filed Jan. 10, 2019, Publication Number WO 2019/140078A1 entitled Acoustic Cymbal Shield for Musical Performance which claims the priority of U.S. Provisional Application Ser. No. 62/616,069 filed Jan. 11, 2018, entitled Acoustic Cymbal Shield for Musical Performance, the disclosures of which are hereby incorporated by reference herein.

BACKGROUND

The present invention relates to the field of musical instruments and, in particular, to an acoustic shield or damper particularly well suited for various types of cymbals.

In musical performances, percussion instruments, such as drums, or a drum set is sometimes placed on stage with other instruments and microphones. In some cases, the percussion instruments may be perceived as too loud, especially in smaller venues. In some cases, the performers have on-stage or in-ear monitors to allow the performers to hear other instruments and performers on the stage. The monitors may reproduce sound picked up in the microphones. As an example, two singers may be able to hear each other through the monitor even when they are not close enough together to hear each other directly. In the same way other sounds including sound from the percussion instruments is picked up by the microphones and played back through the monitors. The percussion instruments may be perceived as loud or annoying in the monitors. When amplification is used for the audience, the percussion instrument sound may be altered by being picked up in other microphones that are not intended for the percussion instruments and then amplified together with e.g. a singer's voice.

In some cases, a drum shield, drum cage, or drum screen is used to attenuate the sound of the percussion instruments. These are typically formed from 1 to 3 meter high acrylic panels that are placed around the percussion instruments as a solid wall or barrier. The acrylic panels allow the percussionist to see other performers but detach the percussionist. The echoes of the percussion sounds within the acrylic panels can also be uncomfortable.

BRIEF DESCRIPTION OF THE DRAWING FIGURES

The appended claims set forth the features of the invention with particularity. The present invention is illustrated by way of example, and not by way of limitation, in the figures of the accompanying drawings in which like reference numerals refer to similar elements.

DETAILED DESCRIPTION

Figure 1:
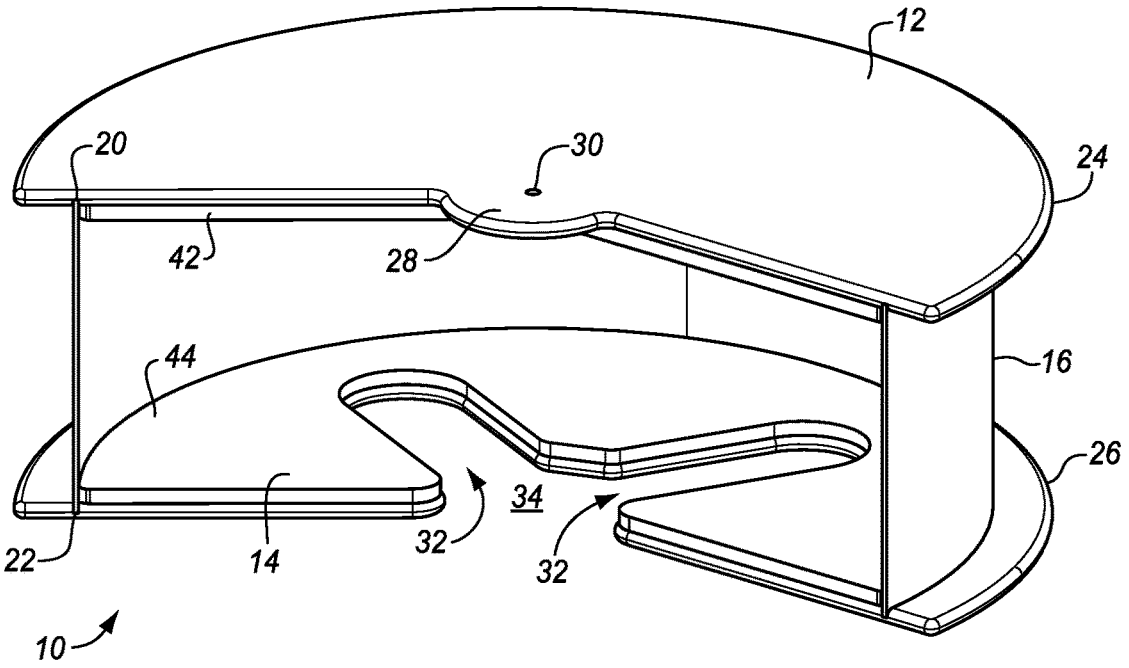
FIG. 1 is a front perspective view of a cymbal shield according to embodiments.

An acoustic shield is described herein that is particularly suitable for cymbals, such as crash cymbals, ride cymbals, splash cymbals, hi-hat cymbals, etc. The shield may also be adapted to other percussion instruments, such as snare drums, chimes, and bells, etc. The shield has a great appearance and provides more precise control over the propagation of sound from the cymbal to other performers, microphones, and the audience. It is useful for live performances and also for recording sessions. Four different elements are described and shown to allow many different levels of control. The results allow acoustic shielding to be optimized for the types of drums or other instruments, the type and configuration of the musical ensemble, the microphone configuration and the size of the venue. The shields are particularly valuable with smaller venues in which cymbal sounds and other sounds can dominate the room.

Cymbals, drums, and other percussion instruments when struck produce a very wide range of simultaneous sound frequencies or pitches from very low to very high. The high pitches will exceed the high range of human hearing. Cymbals, chimes, and bells, produce louder high frequencies than many other musical instruments. This allows the sound to be easily heard over voices, strings, horns, and other sounds. When a listener is very close to a cymbal, the high frequencies may render the cymbal to be perceived as too loud. When a microphone is near a cymbal, and the sound from the microphone is amplified, the amplified high frequencies may become uncomfortable for a listener. If the amplification is tuned for voices or other sound sources, the high frequencies may be overly boosted. In a live performance feedback effects may be caused when high frequency percussion sounds are overly boosted.

The acoustic shields described herein redirect sound away from the nearest members of the audience and other microphones and toward the percussionist and any dedicated percussion microphones. The sounds may also be directed up and down, depending on the particular configuration.

The first element is a sleek and impressive container that partially surrounds a single cymbal. For a more open sound, better look, and freer sound propagation, the container can also have a holed design in the top, bottom, or both of the container. A single cymbal or multiple cymbals can be surrounded by the container.

As a second element, more of the sound is redirected when the holes are removed from the container to contain more of the deflection of the cymbal sounds.

As a third element a highly effective sound foam is added inside the container that is designed to cut higher frequencies of the cymbal sound from traveling outside of the container. This sound foam or acoustic foam reduces the amount of sound sent out from the cymbal. This effect is combined with the reflecting and redirecting effects.

As a fourth element, one or more cymbal spider dampers are placed against one or more of the cymbals. The damper reduces the resonance of the cymbal, reducing the higher frequencies that tend to give people the feeling of the cymbals being too loud. The dampers may have coated tips, mainly for use with smaller cymbals e.g. under 45 cm. The coating allows a brighter, more natural sound to still carry from the cymbal while removing some of the unwanted frequencies and sounds that may be irritating to the ear. A fully coated damper, mainly for cymbals 45 cm and larger, may be used to crush and absorb more of the sounds emitting from the cymbal.

The cymbal spider damper may be installed in at least three different ways, each of which produce a different acoustic effect. A first installation is on the top of the cymbal pressing the ends or tips of the arms against the top of the cymbal. A second installation is under the bottom of the cymbal with arms facing down to fit inside of the bell under the cymbal. The arms contact the cymbal while the ends or tips extend downward and are not in contact with the cymbal. A third installation is under the bell of the cymbal with the tips or ends of the arms pressed against the underside of the cymbal. Each installation provides a different amount and type of damping and different installations may be better or worse for different cymbal types as well as for different venues and desired results.

In addition, a unique adjusting cymbal spacer is described that mounts to an existing cymbal stand and allows the cymbal shield to mount directly to the cymbal stand. The spacer also allows the cymbal position to be modified within the middle of the shield container.

FIG. 1 is a front perspective view of a simplified sound shield 10 for a cymbal which does not include any holes. The shield has a top cover 12 and a bottom cover 14. The top cover and the bottom cover are connected together through a side wall 16. The top and bottom covers may be attached to the side wall and through the side wall in any of a variety of different ways. In the illustrated example, the top and bottom covers are both substantially flat and circular and each has a groove 20, 22 along the periphery of the circle to receive and retain the side wall. The top cover groove is on the bottom surface of the top cover and the bottom cover groove is on the top surface of the bottom cover so that the grooves face each other and are substantially aligned. The side wall rests inside the grooves on its top and bottom edges, respectively. In this example, the top and bottom covers both extend radially out from the side wall so that the circumferences of the top and bottom covers are larger than the circumference of the side wall. This provides a convenient ledge or rim 24, 26 by which the container may be held for transport or adjustment. It also strengthens the structure.

Alternatively, the shield may be made without the ledge or rim for a smoother appearance. The side wall may be formed integrally with the top or bottom by molding or welding or another process so that the transition to the side wall is sharp, curved, or smooth.

Figure 2:
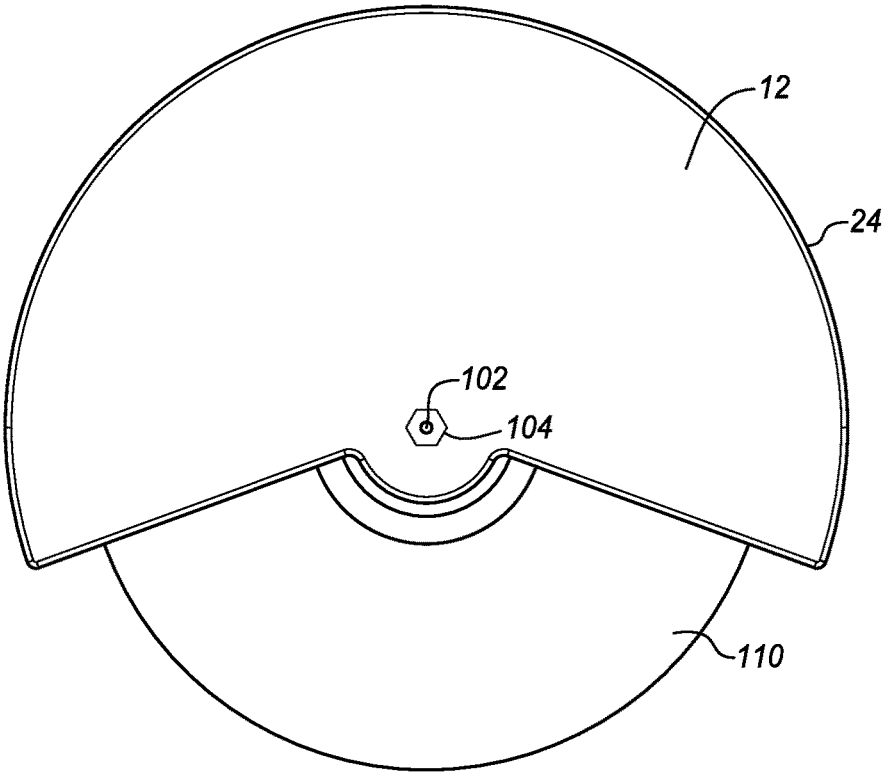
FIG. 2 is top view of the shield of FIG. 1 showing a cymbal according to embodiments.

FIG. 2 is a top plan view of the shield 10. In this example, the top and bottom covers enclose about 210° of a circle, leaving about 150° of the circle open. The open area allows a cymbal 110 to extend from the interior of the shield out the front of the container so that sound may escape and so that the percussionist may strike the cymbal. While a 210° circle is shown, the shield may extend more or less far around the cymbal, depending on the intended effect. For example, the shield may enclose less 90° of the circle or more than 300° of the circle.

Figure 4:
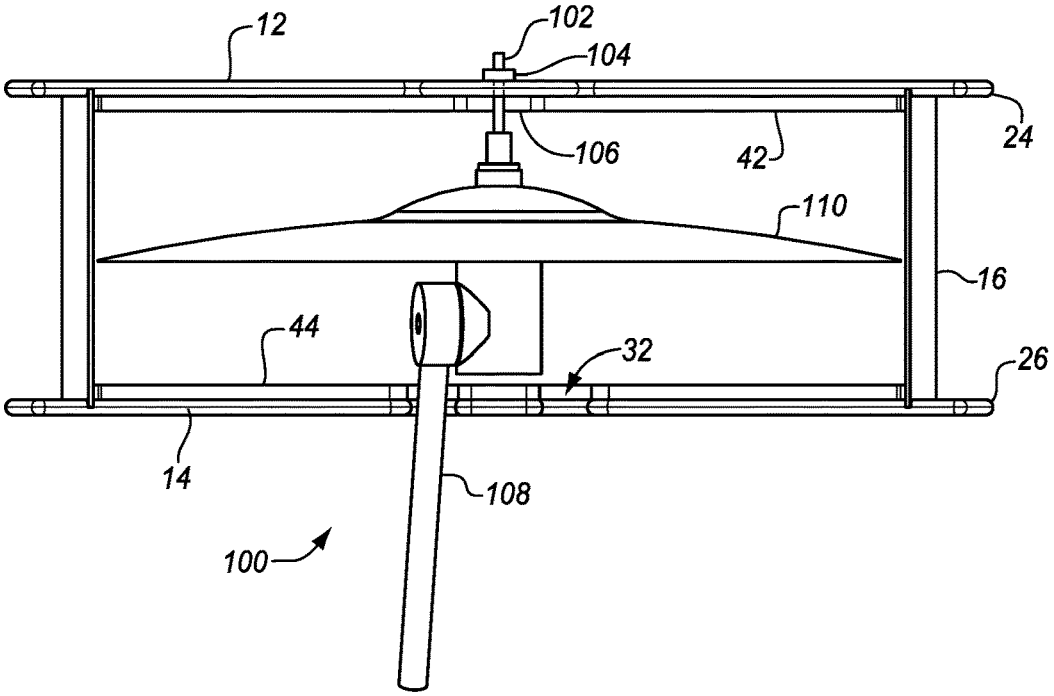
FIG. 4 is a front view of the shield of FIG. 1 according to embodiments.

The top cover has a rounded extension 28 extending from the circular center of the cover. This is configured to engage a stand 100. The cymbal stand may have an extension rod 102 or spacer mount that extends upward from the cymbal as shown in more detail in FIG. 4. The top plate of the shield 10 has a hole 30 through which the rod extends. A suitable flange, ridge, or bushing 106 as shown in FIG. 4 may be positioned on the rod between the cymbal and the top cover to support the top cover. The top cover may be configured to rest on this stand. A fastener 104 such as a nut or clamp may be used to attach the top cover to the rod above the cymbal. In this example, the fastener is attached to the rod over the top plate 12 to hold the bottom or underside of the top plate against the flange, ridge, or bushing.

Figure 3:
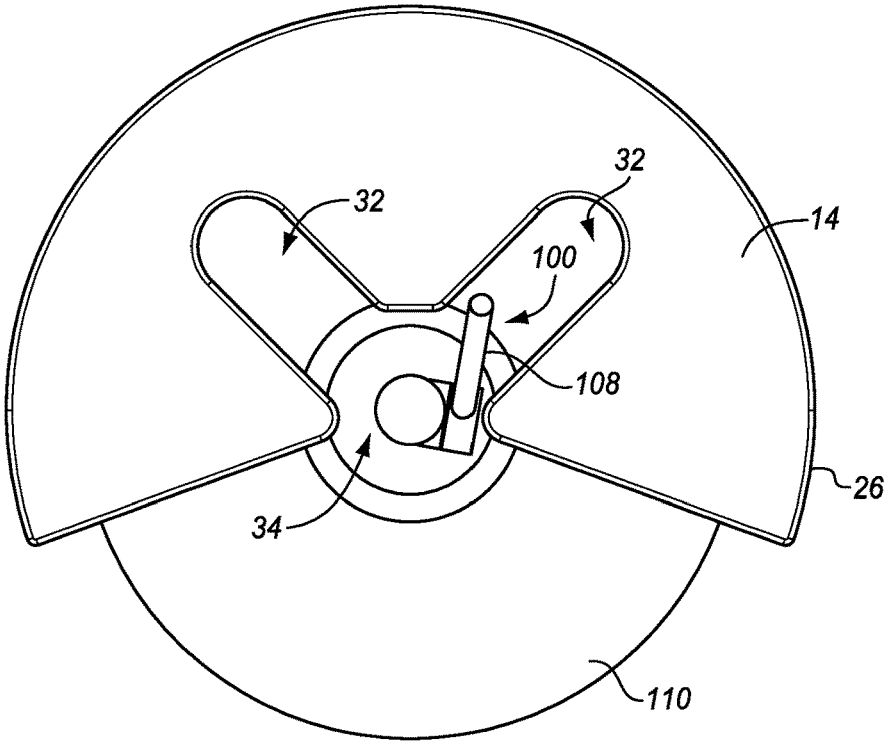
FIG. 3 is a bottom view of the shield of FIG. 1 according to embodiments.

FIG. 3 is a bottom plan view of the shield. As shown, the bottom cover 14 has one or more slots 32, or holes 34 through which the cymbal stand 100 can pass. In the example of FIG. 3, there is a central opening 34 and two slots 32 extending radially from the central opening. The central opening allows a stand to extend vertically down from the top plate to the floor or to another mounting location. The slots allow an arm 108 of the stand 100 to extend at an angle from the cymbal. The angled arm may attach to a vertical stand or to some other object such as a bass drum or other support structure. The configuration of the hole and the slots may be modified to suit different cymbal support systems.

FIG. 4 is a front plan view of the shield 10. The top plate and the bottom plate are substantially parallel and spaced apart with sufficient room for one or more cymbals 110 between the top and the bottom plate. Additional space is provided between the top and the bottom plate to accommodate any normal or regular movement of the cymbal. As an example, when a cymbal is hit with a stick it will move away from the strike rotating downward away from the stick with respect to its attachment to the cymbal stand, where the attachment to the cymbal stand typically serves as a universal joint and a damper with rotation in all directions but with limited range.

The shield is attached to the cymbal stand using an extension rod 102 or spacer that, in some cases is screwed in to the top of the cymbal stand. The spacer rod has internal threads to attach to the stand in the same way as the nut that would otherwise be used. A flange 106 threads onto the spacer mount to a position that can be selected to accommodate the particular cymbal. A nut 104 then screws onto the spacer rod above the shield top plate to hold the shield against the flange.

As also shown in FIG. 1, an isolating plate 42 is attached to the underside or bottom surface of the top cover and a second isolating plate 44 is attached to the roof or top surface of the bottom cover. The isolating plates may be made of a reinforcing material, an acoustic material, both materials, or a material with both characteristics. The plate may be in multiple layers to perform multiple functions using more than one different material. In some cases, the isolation plate is made of acrylic or metal to reinforce the top and the bottom plate. In some cases, the isolation plate is made of an acoustic material that absorbs high frequency sounds, such as the foam described above. The foam may be closed or open cell, depending on the desired characteristics. The particular frequencies of the sound that is absorbed be the isolation plate may be adapted to suit different implementations and different types of cymbals.

While the acoustic material is shown as present on the top plate 12 or the bottom plate 14, an acoustic material may be applied or attached to the side wall 16 as an alternative or in addition to the top plate, the bottom plate, or both. The acoustic material may cover the entire interior of the side wall or just a portion, depending on the intended effect. The acoustic material may be in a sheet form that is cut to size and attached with an adhesive. Alternatively an adhesive acoustic material may be applied by spray, clamp, or another means. As a further alternative, one or more of the shield top plate, bottom plate, and side wall may be made of the acoustic material, instead of having the material applied.

FIG. 4 shows a crash, ride, or splash cymbal mounted to a stand and the shield mounted to the stand above the cymbal. This configuration is well suited to a common type of stand for a crash cymbal, ride cymbal, china cymbal, splash cymbal, hi-hat cymbals, and many other type of cymbals. It may also be adapted for bells, chimes, and other instruments as well as for a variety of different drums.

Figure 5:
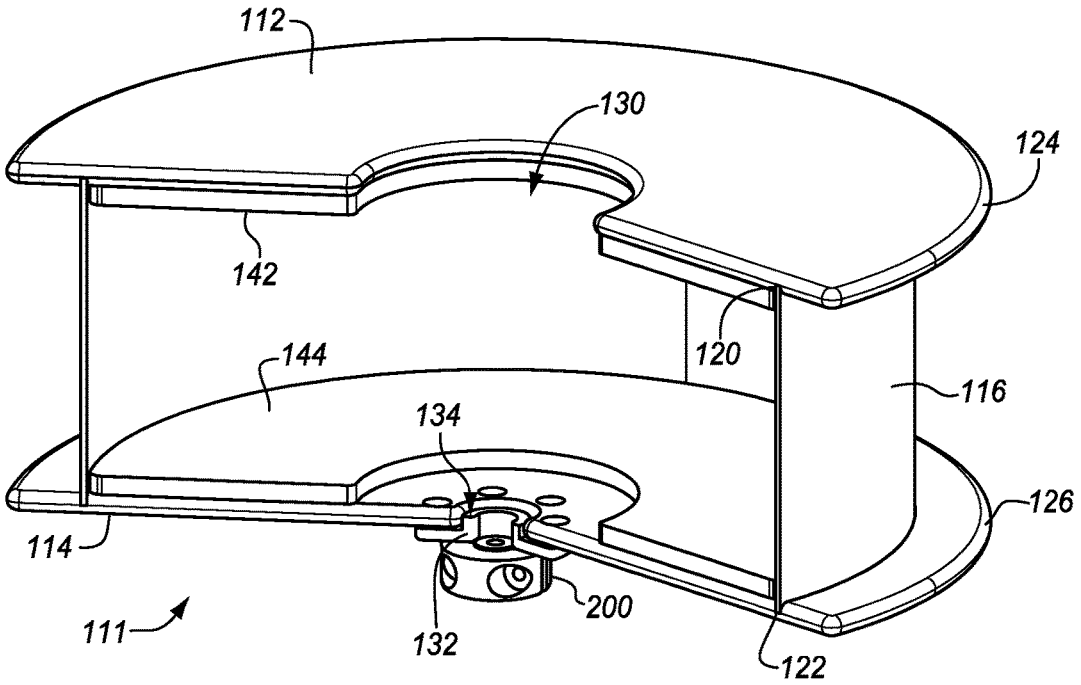
FIG. 5 is a front perspective view of an alternative embodiment of the shield for a hi-hat cymbal showing a clamp for a hi-hat stand according to embodiments.
Figure 6:
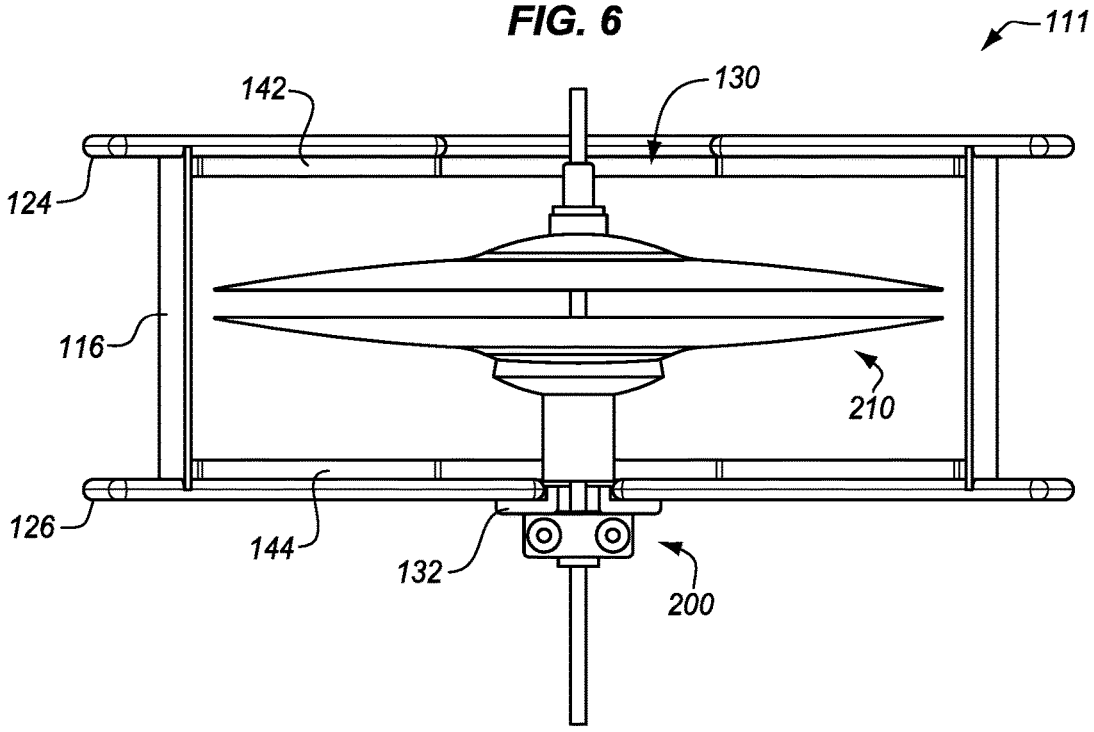
FIG. 6 is a front view of the shield of FIG. 5 showing the hi-hat cymbal and a portion of the stand according to embodiments.

FIG. 5 is a perspective front view of an alternative shield 111 that is configured to attach below the cymbal instead of above the cymbal as in FIG. 1. FIG. 6 is a front plan view of the alternative shield 111 and shows a hi-hat cymbal 210 having two facing cymbals mounted to a stand 200 and in which the top cymbal moves up and down with a foot pedal. The shield 111 is mounted to the stand below the two cymbals. This configuration is well suited to a common type of hi-hat stand. Either type of shield configuration may be used for any of a variety of different types of cymbals depending on the configuration of the stand and any suitable mounting locations.

As shown in FIG. 5, a top plate 112 has a central circular opening or hole 130 to allow the cymbal stand to extend up, through the opening, above the top plate, and out of the interior of the shield 111. The bottom plate 114 has a much smaller opening 134 through which the bottom of the stand extends. A bracket 132 is mounted to the bottom plate 114 with a set of fasteners configured in a ring. In this example, the bracket 132 mounts to the stand using a locking ring 200 and the bottom plate 114 mounts to the bracket 132. The locking ring in this example is built as two half rings so that the back half is attached to the bracket 132. The stand 200 is placed into the back half of the ring. The front half of the ring is then screwed onto the back half of the ring to clamp the ring around the stand. A rubber grommet or other gripping surface may be used with in the ring to better grip the stand. Other attachment techniques may be used instead of or in addition to that shown.

The top and bottom plate are spaced apart by a side wall 116 that is attached to grooves 120, 122 in the plates as in the example of FIG. 1. The top and bottom plates have ledges 124, 126 extending out beyond the side wall to allow the shield to be gripped and moved. The side wall has a height with enough room to allow both cymbals to be enclosed within the shield and to allow the top cymbal to move vertically with the foot pedal. Additionally room may be provided between the top plate and the bottom plate to allow the cymbals to move when struck. Typically a hi-hat can rotate about the stand in any direction but does not have as much range of motion as the crash cymbal.

The version of FIG. 5 also has isolation plates 142, 144 similar to those of FIG. 1 but the specific configuration is different to accommodate the different mounting configuration. Further variations may be made to the mounting configuration to further implementations including different types of cymbals, different types of stands, and different intended results.

Figure 7:
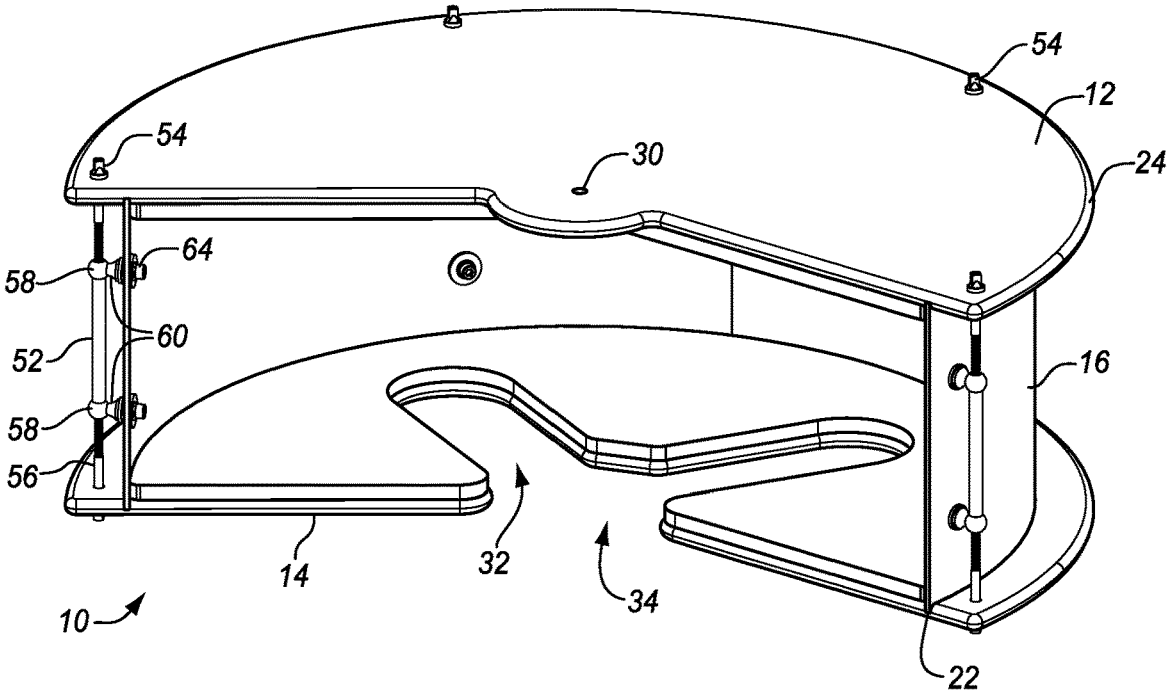
FIG. 7 is a front perspective view of an alternative cymbal shield with lugs according to embodiments.

FIG. 7 is a front perspective view of a variation of the shield 10 of FIG. 1 which includes four lugs 52 equally spaced around the circular side wall 16 of the shield outside of the interior or container of the shield. More or fewer lugs may be used, depending on the desired appearance and structure. Alternatively, the lugs may be placed in the interior of the shield. This may be particularly suitable when there is no ledge or ridge 22, 24 on the top and bottom plate 12, 14. Each lug 52 attaches to the top plate 12 and to the bottom plate 14 with respective tension screws 54, 56. The screws 52, 54 extend through respective holes in the top and bottom plates 12, 14 and screw into and attach to respective ends of tension rods 52 that connect to the top and bottom screws. The top and bottom plates are attached to each other through the tension rods. For 210° partially circular top and bottom plates, the lugs in this example are about 50° apart around the circumference of the top and bottom plates. Accordingly there are four tension rods around the shield as shown by the four lugs visible around the top plate.

The tension rods serve to reinforce the shield and provide extra strength to the shield. They absorb impact forces and strains that might separate the top or bottom plate 12, 14 from the side wall 16. In addition, they provide a decorative element so that the shield resembles a drum. The side wall may be decorated to also resemble a drum or in any of a variety of other ways. For example, in a drum kit in which the drums have a red sparkle finish, then the side wall of the shield may also be or be covered in a similar red sparkle finish. The top and bottom plates may be configured to look like drum heads and drum hoops. Alternatively, the shield may be made transparent or transparent in parts to allow better visibility and to show the cymbal or cymbals inside. The shield may be made of any of a variety of different materials including acrylic, metal, such as aluminum, wood, wood composites, bamboo or other grasses, carbon fiber or acoustic foam, etc.

Another decorative element for the side wall is a video or light panel. A variety of video and light sheets are available with flexible substrates that can be attached to one or more shields. These panels allow various lighting and video effects to be displayed by the shields. This paneling may be connected to a computer or other controller in order to program a desired effect of lighting, words, designs, or video for the audience. The paneling can be made up of LED, OLED, LCD, pixels, screens, or like materials. Panels can also be connected to other devices such as additional panels, screens, or shields for the desired effect.

The tension rods 52 are also attached to the side wall 16 in this example. There are two suspension nuts 64 that attach directly to the side wall, although there may be more or fewer. The lug has a retainer 58 which has s threaded post 60. The threaded post passes through a corresponding hole in the side wall until a flange 62 of the post 60 abuts the side wall and the nut 64 is fastened to the post on the other or interior side of the side wall to hold the lug and tension rods in place against the side wall. The flange locates the lug at a specific distance from the side wall. Washers may be used with the flanges or elsewhere as desired to spread any force over a larger area. These additional retainers allow the tension rods to further strengthen the shield. The lug retainers also provide an improved appearance.

The shield 10 is otherwise similar to or the same as that of FIG. 1 with an opening 34 and slots 32 in the bottom plate for the cymbal stand 108 to pass through and hold a cymbal 110 within the shield. The shield top plate has a central hole 30 so that the top of the spacer mount 102 passes through the hole and holds the shield in place with a flange 106 and nut 104 or other suitable fastener.

Figure 8:
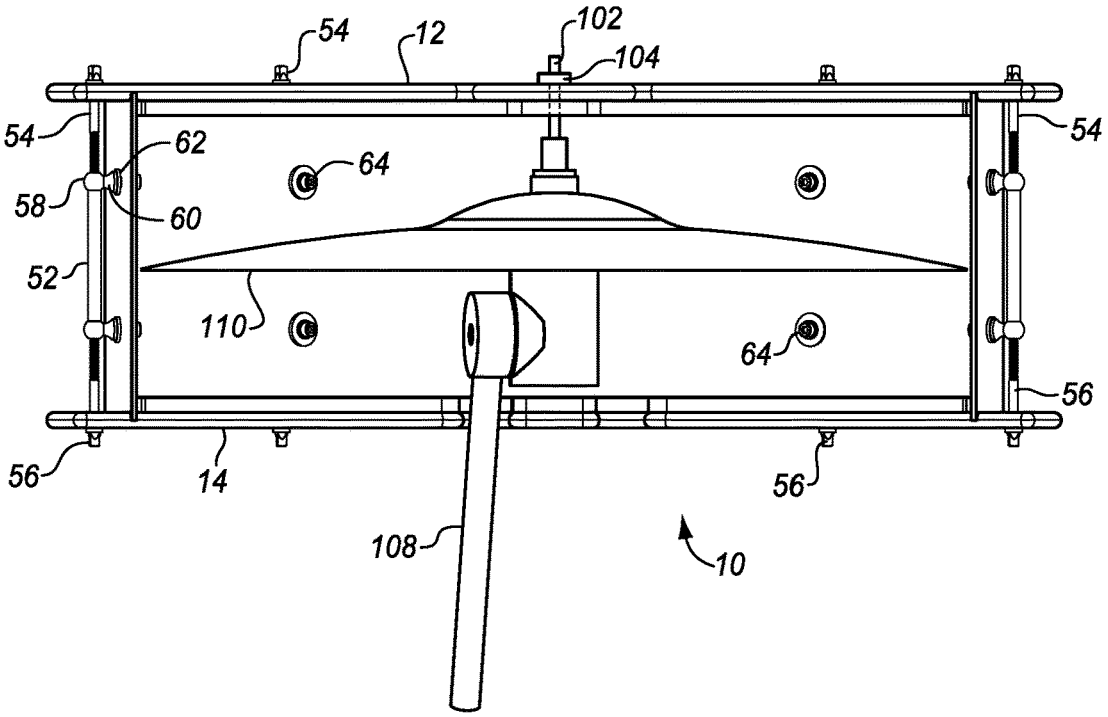
FIG. 8 is a front view of the shield of FIG. 7 according to embodiments.

FIG. 8 is a front plan view of the shield of FIG. 7 showing a cymbal 110 inside mounted to a stand 108 and in which a spacer mount 104 attached to the top of the stand 108 extends through the hole 30 to carry the weight of the shield on a flange 106 mounted to the spacer. FIG. 8 shows clearly that the tension screws 54, 56 extend through the top and bottom plates 12, 14 respectively into opposite ends of the lug 52. The retainers 58 extend into the side wall 16 to hold the retainer in place. The two retaining nuts 64 or screws, depending on the implementation, for each of the other two lugs are also clearly visible attached to the inside of the side wall.

Figure 9:
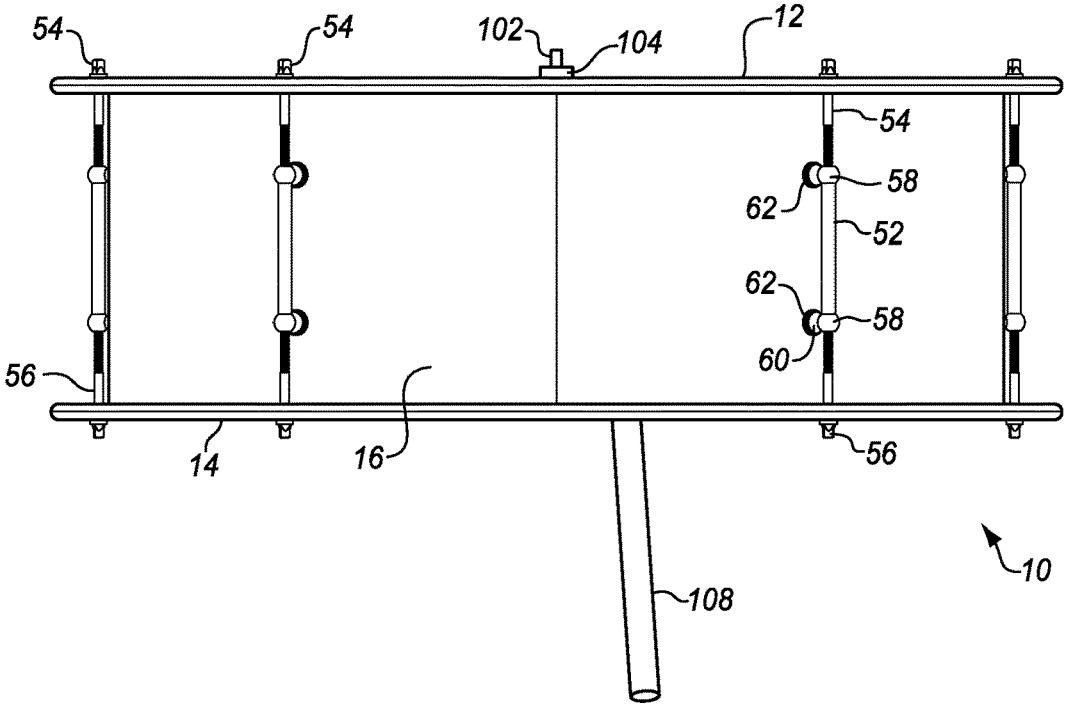
FIG. 9 is a back view of the shield of FIG. 7 according to embodiments.

FIG. 9 is a rear plan view of the shield of FIGS. 7 and 8 showing all four lugs 52 and attached tension rods around the back side of the shield. Typically this side is facing away from the percussionist and toward the listener. The side wall 16 extending around the circumference of the shield reflects or blocks some of the cymbal sound from reaching the listener. The side wall and the lugs may be configured to provide an attractive appearance to the listener.

Figure 10:
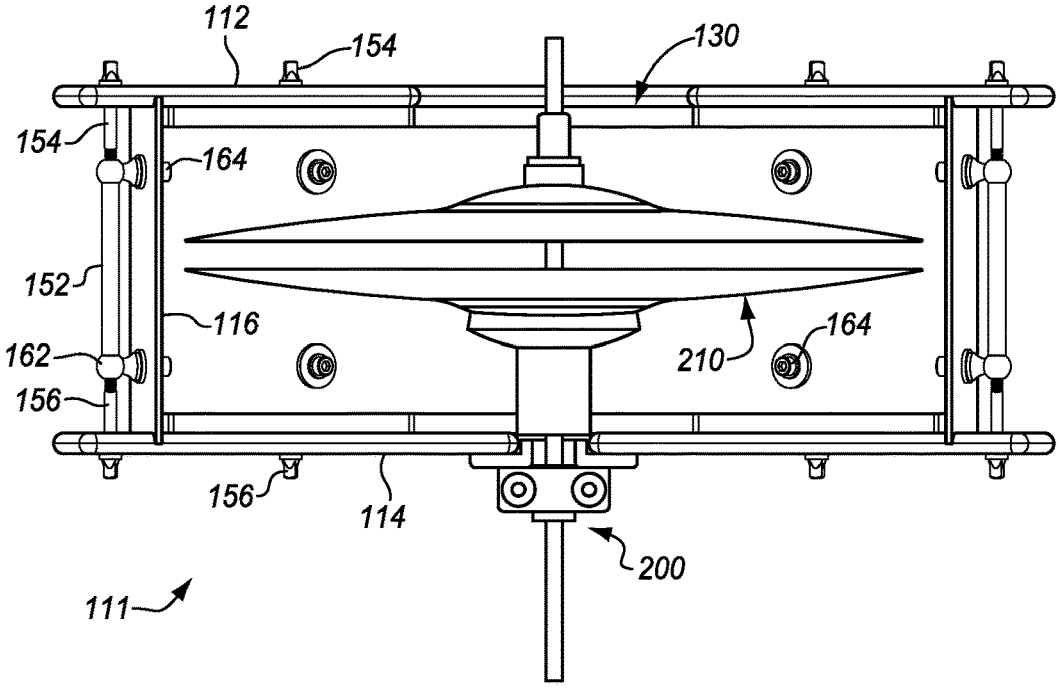
FIG. 10 is a front view of another alternative embodiment of the shield with lugs for a hi-hat cymbal showing the hi-hat cymbal and a portion of the stand according to embodiments.

FIG. 10 is a front plan view of the alternative shield 111 suitable for use with a hi-hat 210 stand 200 or other stand that supports the shield from the bottom of the shield. As in FIG. 6, the shield has a top 112 and bottom plate attached to a circular side wall 116 subtending a portion of a full circle. The cymbals 210 are accessible from the open part of the shield for play and for sound from the cymbals to be released.

Lugs 152 are similarly attached around the periphery of the shield with tension rods 154, 156 extending though the top and bottom plates to the tension rod. The tension rods are further optionally secured to the side wall 116 by retainers 162 that extend through the side wall and are attached by nuts 164 on the inside of the side wall. The tension rods and lugs throughout the present description are shown and described having a construction similar to that used to attach drum heads to drums. The particular construction and connection of the tension rods may be adapted and modified for this use. As an example, it is not necessary to maintain a very high, precise, and even pressure on the top and bottom plate as may be necessary with a drum head. Accordingly, the attachment to the top plate may be made simpler or less secure in different ways.

Figure 11:
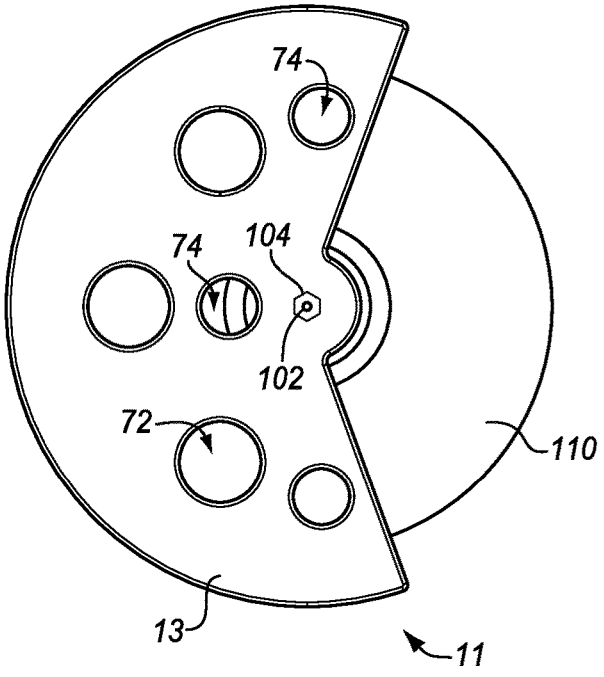
FIG. 11 is top view of a shield with holes above a cymbal according to embodiments.

FIG. 11 is a top plan view of an alternative embodiment of a shield 11 similar to that of FIG. 1. In this embodiment the top 13 and bottom 15 plate each have an array of cutouts or holes 72, 74. In this example the holes are circular, differently sized, and arranged or distributed evenly on the surface of both the top and the bottom plate in generally circular and concentric patterns. The holes are not aligned between the top and the bottom plate and do not need to be aligned, but may be aligned. While circles are shown and applied in circular patterns, a variety of other hole shapes and patters of holes may be used to suit different implementations. The holes are arranged to allow room for the cymbal stand 108 and the top cymbal stand post 102 and nut 104. A hole may also be configured to allow for a microphone to acoustically couple to the cymbal. The holes go through the top and the bottom plate and also through the corresponding isolation plates.

Figure 12:
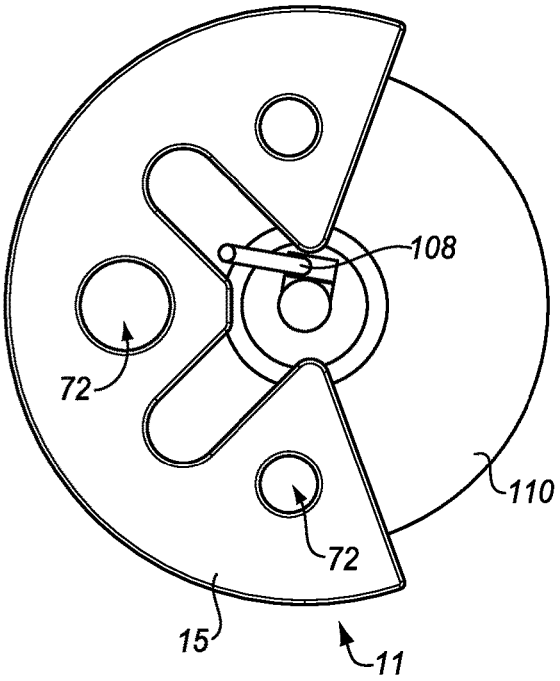
FIG. 12 is a bottom view of a shield with holes below the cymbal according to embodiments.

FIG. 12 is a bottom plan view of the same shield 11 showing the bottom plate 15. The holes are arranged around the slots and central hole for the cymbal stand. The holes provide an attractive aesthetic appearance, reduce the weight of the container, and allow sound to exit through the top and bottom plates. The size of the holes may be adapted to control the amount of sound that is released and the amount of strength or rigidity for the containers.

As shown, there are three large holes and three small holes in the top plate. These are distributed roughly evenly across the surface the surface of the top plate. There are also three large holes in the bottom plate, each separate from the other by the slots for the cymbal stand. In the case of a single central hole for a cymbal stand, the holes may be distributed in the same way as in the top plate, in an inverse way or in another way. The holes may also be configured to allow more or less sound to propagate upwards through the top plate as compared to the sound that propagates down through the bottom plate by having more or larger openings in one plate than in the other plate. There may be more or fewer holes and the sizes of the holes may be modified to suit different implementations.

Figure 13:
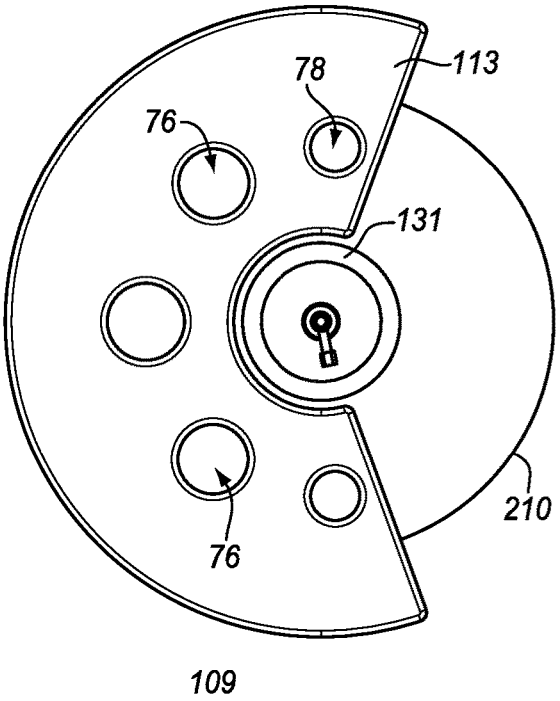
FIG. 13 is a top view of a shield with holes above a hi-hat cymbal according to embodiments.

FIG. 13 is a top plan view of an alternative embodiment of a shield 109 similar to the shield of FIG. 5 suitable for use with a hi-hat 210 and stand or similar type of stand. The top plate 113 has large holes 76 and small circular holes 78 arranged in a circular pattern around the central hole 131 of the top plate. Other holes shapes and arrangements may be used instead. The central hole is configured to accommodate the top of the hi-hat stand as described above.

Figure 14:
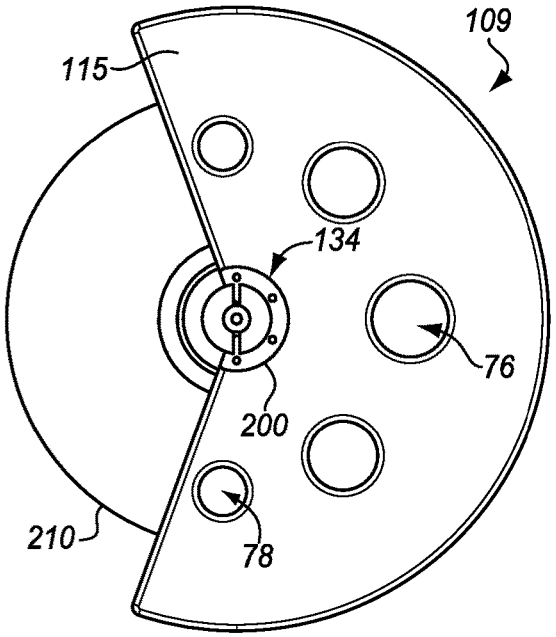
FIG. 14 is a bottom view of a shield with holes below the hi-hat according to embodiments.

FIG. 14 is a bottom plan view of the shield 109 of FIG. 13 showing a similar circular arrangement of round holes 76, 78 in the bottom plate 115. As in the above examples only the top or the bottom plate may have holes so that the cymbal sound escapes the shield in only one direction. In these examples holes are shown on top and bottom as an example.

Figure 15:
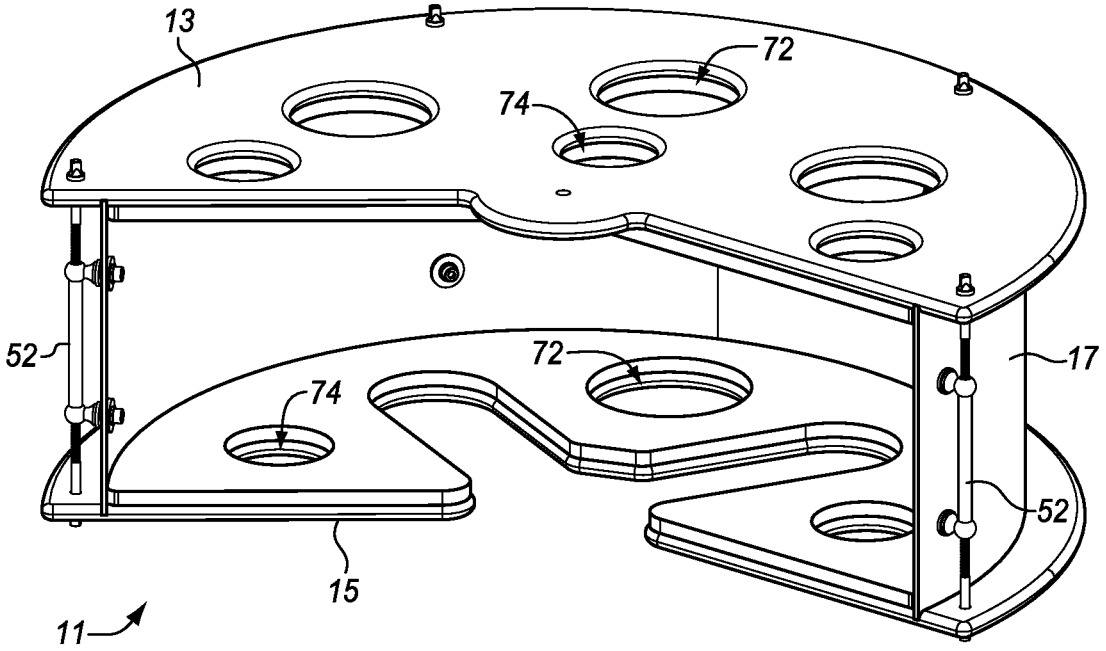
FIG. 15 is a front perspective view of another alternative cymbal shield with holes and lugs for a cymbal according to embodiments.

FIG. 15 is a front isometric view of an alternative shield configuration. In this example, the shield 11 has both lugs 52 as in FIG. 7 and holes 72, 74 as in FIG. 11. The combinations and configurations of holes and lugs may be adapted to suit different embodiments. The lugs attach to the top plate 13, bottom plate 15 and side wall 17 to provide additional strength and stability. The added structure may be more important when the top and bottom plates are weakened by the holes. An acoustical damping material 14 is also used on the top and bottom plates as described above.

Figure 16:
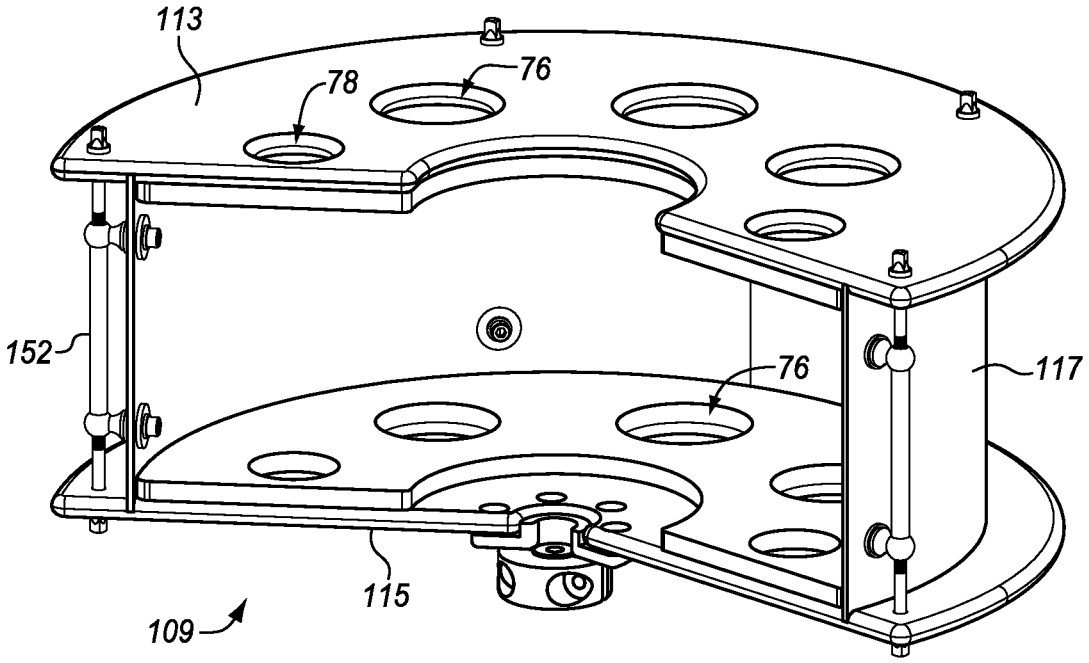
FIG. 16 is a front perspective view of another alternative embodiment of the cymbal shield with holes and lugs for a hi-hat cymbal according to embodiments.

FIG. 16 is a front isometric view of an alternative hi-hat shield 109 with holes 76, 78 and lugs 152. The holes are in the configuration shown in FIGS. 13 and 14 but any other suitable configuration may be used. The described shields may be used for multiple cymbals as well as for other instruments, including drums.

Figure 17:
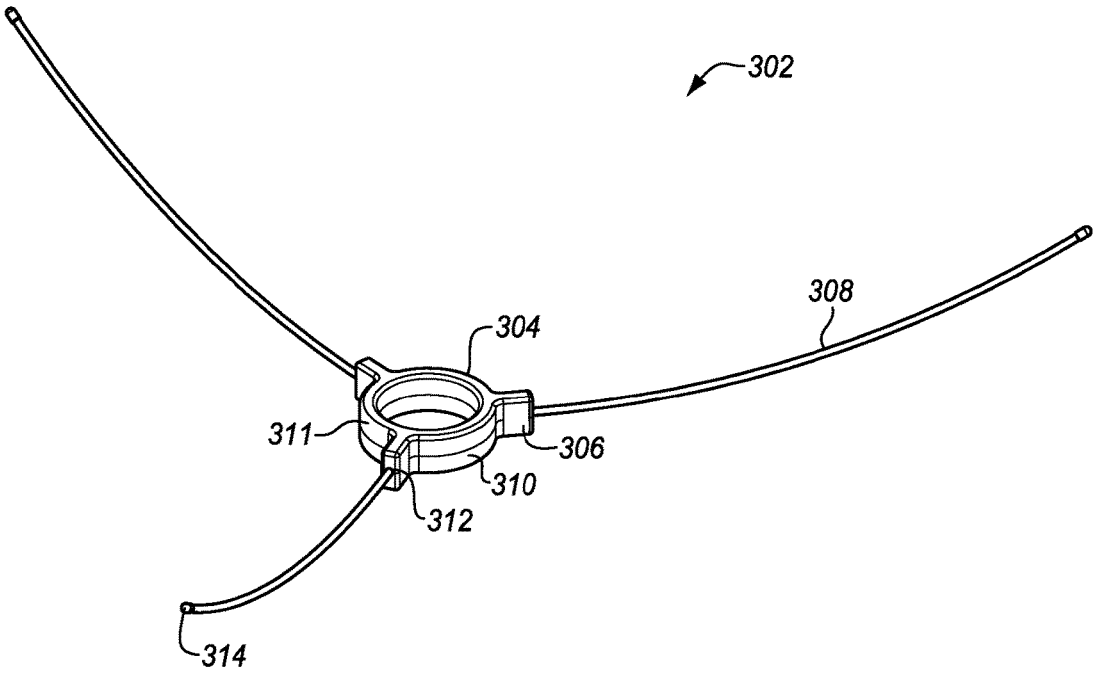
FIG. 17 is a bottom perspective view of a cymbal damper according to embodiments.

FIG. 17 is an isometric view of an acoustic damper configured for use with a cymbal on a stand. The damper has a ring 304 configured to encircle the cymbal stand with a protrusion 306 for each finger 308. The damper is mounted by inserting a rod of the cymbal stand through the open middle of the ring. The fingers are held in a hole 312 in each protrusion and extend away from the protrusion to a tip 314 at the opposite end of the finger. The ring may be made of any of a variety of different materials. In the illustrated example, the ring has an inner circular section and three outer sections 310, 311 that fit over the inner section. Each section has one half of two different protrusions 306 at each end of the section so that when the outer sections are attached to the inner section, the two halves of each protrusion are pressed together to form a single protrusion and to hold a respective finger between the two respective protrusion halves. In some embodiments, the ring may be made of a hard plastic glued together, molded, composite, rubber, metal, or other materials with fingers made of steel wires, for example stainless steel wires tipped or coated in a synthetic rubber. The fingers may alternatively be made of composite, plastic or other material.

This further acoustic cymbal device may be used with or without a corresponding shield. The acoustic device functions in part by damping the resonance of a cymbal. The central ring attaches to the stand either above or below the cymbal and one or more fingers extend from the attachment ring to contact the cymbal. While the damper is described as having three fingers and three fingers provides a good effect in many circumstances. More or fewer fingers may be used to increase or reduce the effect.

In the illustrated examples, the fingers are all curved in the same direction through an arc that starts at the ring to a tip which is at the same point for each finger. The arc may curve both in horizontal and vertical planes. The fingers may be coated with an elastomeric acoustic dampening material, synthetic rubber, or another sound absorbing material at the tip or along the entire length. The amount of material including the length and thickness of the material may be selected to achieve the desired acoustic properties. While three fingers are shown, a single finger is enough to provide some benefit. More than three fingers may be used to damp still more finger sound.

Figure 18:
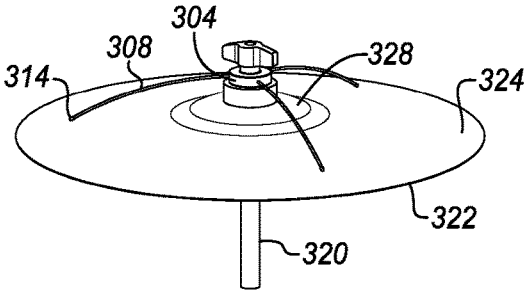
FIG. 18 is a side view of the cymbal damper attached above a cymbal to damp the ride area according to embodiments.

The damper may be coupled to a cymbal in at least three different ways. More than one damper may be used with each cymbal. FIG. 18 is a side plan view of a first approach in which the damper ring 304 is mounted to a cymbal stand 320 above the cymbal 322. The ring may be attached so that the ring rides vertically along the rod of the stand. The ring and the fingers are free floating and have only a light gravitational pressure on the cymbal. Similarly the ring and fingers may rotate about the stand. Alternatively, the ring may be attached in a fixed position so that it cannot move vertically or rotate. The fingers 308 extend downward in an arc or curve vertically from the ring to contact the top of the cymbal surface, although straight fingers may be used instead. The fingers extend past the crown of the cymbal bell 328 to contact the cymbal in the ride area 324. The fingers absorb vibrations from the cymbal which are then also absorbed by the dampening material and may also by transmitted to the cymbal stand through the ring. In another embodiment, the fingers do not extend past the bell but contact the bell.

Figure 19:
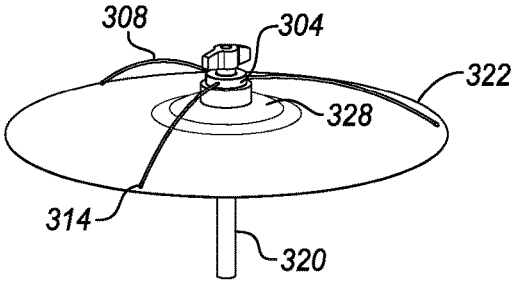
FIG. 19 is a side view of the cymbal damper attached above a cymbal to damp the crash area according to embodiments.

FIG. 19 is a side plan view of a second approach similar to FIG. 18 in which the fingers are longer or the cymbal is smaller. The damper ring 304 is attached to a similar or the same position on the cymbal stand 320. The fingers 308 extend outward from the ring in an arc downward vertically from the ring to contact the cymbal 322 past the bell and the ride area at the crash area 326. The fingers may have dampening material on the tips 314 or along the some or all of the length of each finger. The dampening material provides a resilient physical contact with the cymbal surface to absorb resonant vibrations of the cymbal. The length of the fingers and diameter of the cymbal may be modified so that the fingers contact the cymbal at any desired location to achieve a desired acoustic effect.

Figure 20:
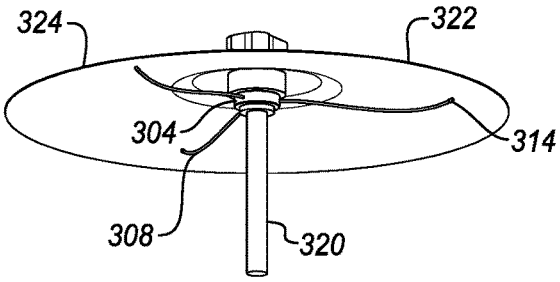
FIG. 20 is a side view of the cymbal damper attached below a cymbal to damp the ride area according to embodiments.

FIG. 20 is a side plan view of a third approach with the damper ring 304 mounted to the cymbal stand 320 below the cymbal 322 in an inverted configuration so that the tips 314 of the fingers 308 contact the underside or bottom of the cymbal surface. The cymbal is shown as transparent so that the fingers can be seem more clearly. In this example, the tips contact the cymbal in the ride area 324. This has a similar effect to the top mounting position in which the fingers contact the top of the cymbal in the same ride area but on the opposite side of the cymbal. In both cases, the lengths of the fingers may be configured to contact the cymbal at a more central or more peripheral position. As the fingers are made longer to contact more peripherally, the damping effect is increased. Two dampers may be used for a single cymbal one above and one below the cymbal for an increased effect.

Figure 21:
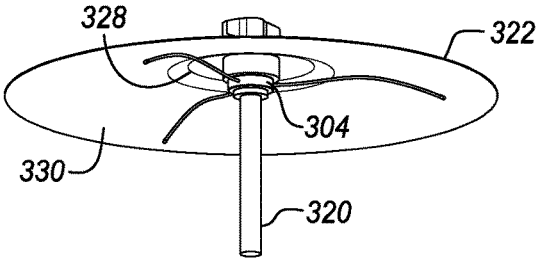
FIG. 21 is a side view of the cymbal damper attached below a cymbal to damp the bell edge according to embodiments.

FIG. 21 is a side plan view of a fourth approach in which the damper ring is inverted below the cymbal. As in FIG. 20, the damper ring 304 is mounted on the cymbal stand 320 below the cymbal 322 at the center of the cymbal. However, in this example, the damper is inverted and the fingers extend downward away from the cymbal opposite to the previous example. In many cases, a cymbal has a raised center, called the bell 328 and the damper ring is mounted up on the cymbal stand within the bell. The surface of the cymbal has a conical fall from the bell at the center of the cymbal outwards a few centimeters along the sides of the bell. The shape of the surface of the cymbal then has an inflection point from the steeper fall of the bell 328 to a gentler fall of the ride area 324. The cymbal then extends further outward with a much slower fall from the ride area to the crash area 326. The cymbal may also have particular shapes and materials applied to its periphery at the crash area to alter the sounds.

The inflection point between the bell and the ride area provides a ridge as seen from the underside of the cymbal. With the damper attached close to the center of the cymbal, the back sides of the fingers may be positioned to contact the ridge under the cymbal and may also contact a part of the bell area 328. With the fingers coated or uncoated at the point of contacting the ridge, sound energy or vibrations from the cymbal may be absorbed by the fingers and then propagated along the fingers in two directions toward and away from the ring. This difference in the damping provides a different acoustic effect as does the difference in the point of contact against the cymbal.

Figure 22:
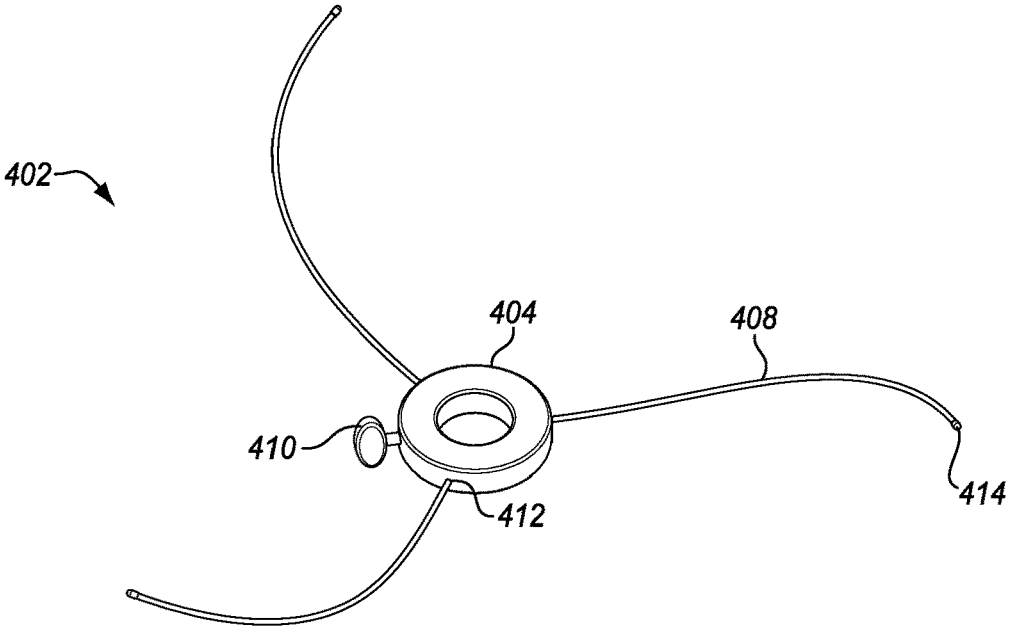
FIG. 22 is a bottom perspective view of an alternative cymbal damper according to embodiments.

FIG. 22 is an isometric view of an alternative configuration of a damper 402. The damper has a central ring 404 with a central hole configured to attach to a cymbal stand. The cymbal stand slides through the ring and the ring is optionally held in place on the stand by a set screw 410 that pushes against the stand. In this example, the ring has three holes 412 each configured to receive and hold a finger 408 which may be made from a wire, for example a steel wire, or other material. Each wire has a dampening material at its tip 414 opposite the ring or along more of its length. The fingers may be attached to the ring with adhesive or by brazing, soldering, welding or heat shrink techniques.

Figure 23:
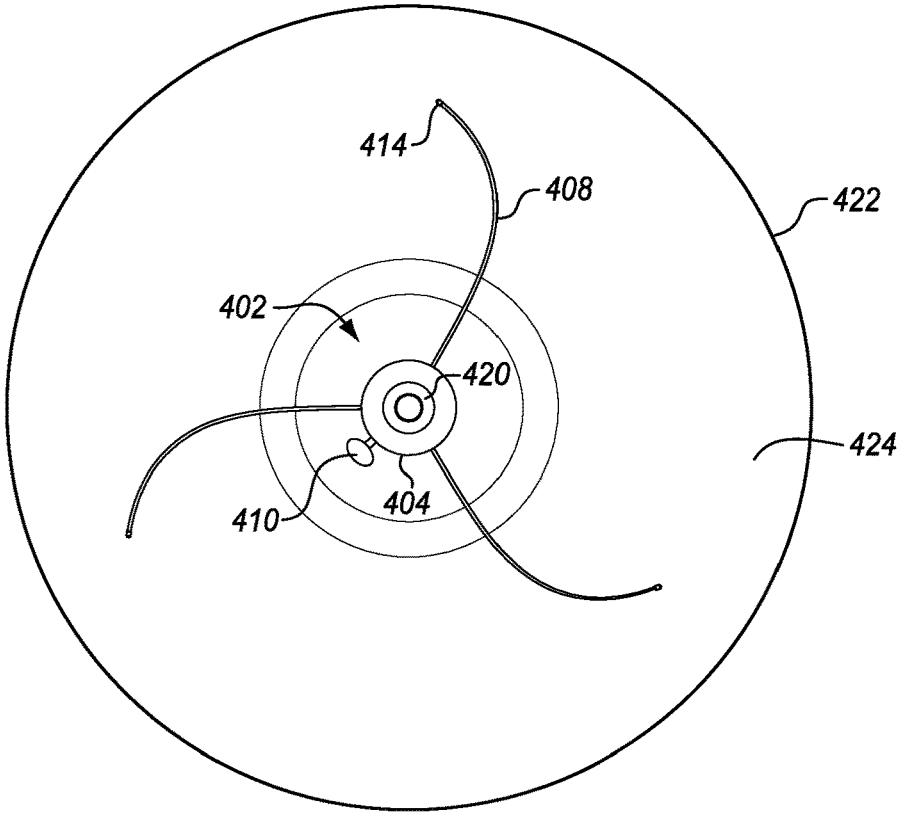
FIG. 23 is a top view of the cymbal damper attached above a cymbal to damp the ride area according to embodiments.

As shown, the fingers are curved in this and the other examples. The fingers have a resilience so that when the fingers are pressed against the cymbal, the tension from the position of the ring applied through the fingers will hold the fingers against the cymbal. When the cymbal is played it will move on the stand and the resilience of the fingers allows the cymbal to move and maintain or quickly recover physical contact with the cymbal. In some embodiments, the fingers may be bent to adjust the position at which the fingers contact the cymbal. Bending may also change the tension of the fingers against the cymbal FIG. 23 is a top plan view of a damper 402 mounted by its ring 404 to a cymbal stand 420. The fingers extend outward from the ring over the bell 428 of the cymbal 422 to contact the cymbal at the finger tips 414 in the ride area 424. The fingers are shown as subtending an arc in the horizontal plane as well as in the vertical plane as shown in FIG. 18. This arc allows the fingers to be longer than if they were straight in the horizontal plane. The additional length allows for more material in the finger to absorb resonant vibrations of the cymbal. The additional length allows the fingers to be bent to adjust the position on the cymbal at which the tips contact the cymbal.

Figure 24:
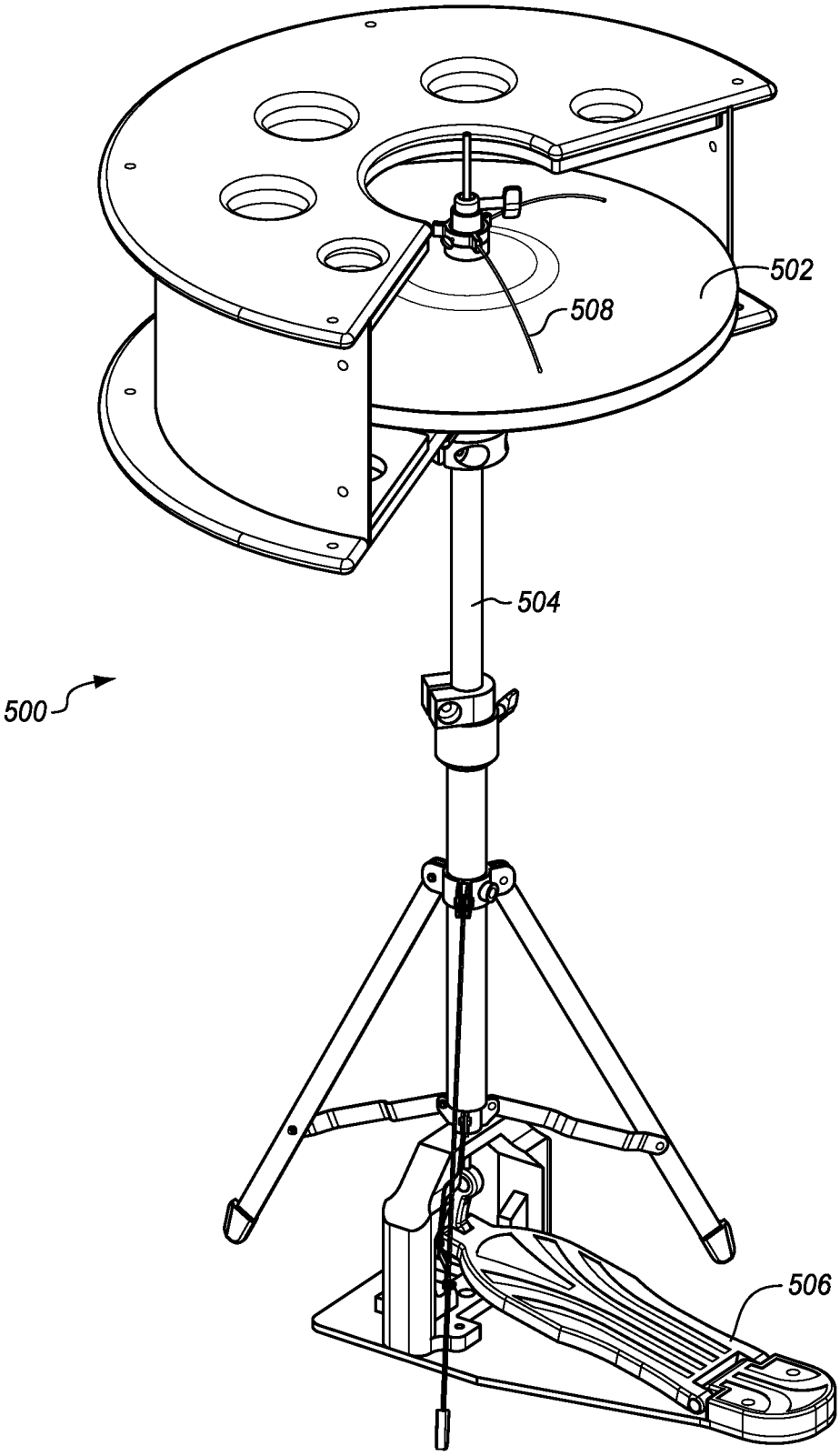
FIG. 24 is a front perspective view of a hi-hat cymbal and a stand with a shield and damper according to embodiments

FIG. 24 is a perspective view of an example of a complete a hi-hat stand 504 with foot pedal 506 and hi-hat cymbals 502 with acoustic shield 500 attached. The central attachment point between the stand and the shield is not visible under the cymbals. The central opening of the shield is visible to show how that the top cymbal and a portion of the stand are able to move vertically with the foot pedal. In this example, a damping spider 508 is also attached to the stand above the top cymbal. A similar damping spider may be mounted below the lower cymbal.

Figure 25:
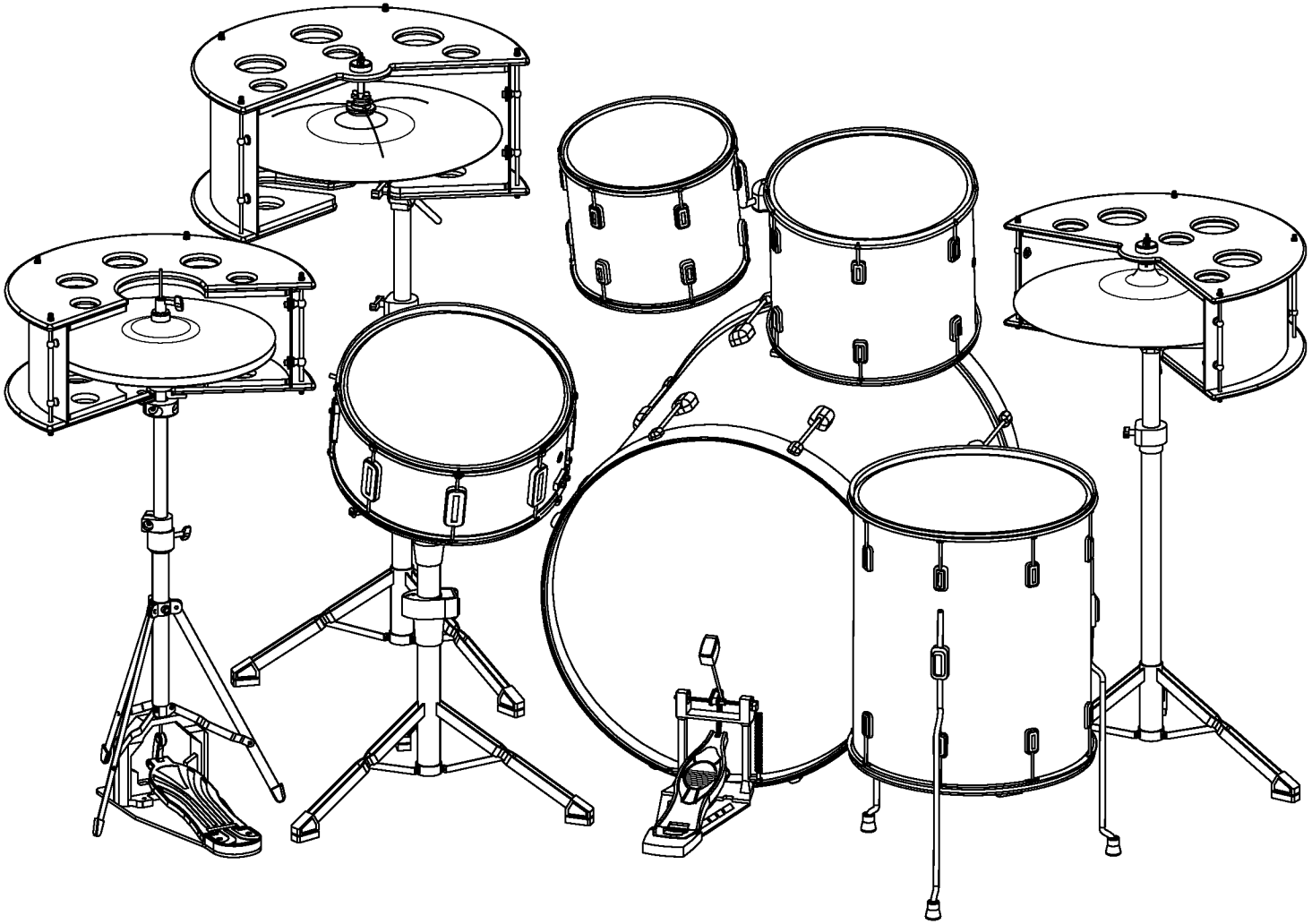
FIG. 25 is a front view of a drum set with multiple cymbals each having a shield and a damper according to embodiments.

FIG. 25 is a front view of an example of a drum set with cymbals of different sizes and types and with shields attached to each of the cymbal stands.

The described embodiments provide a variety of different benefits. One benefit is to control the direction of the sound that propagates from the cymbal. Typically sound from a cymbal propagates in all directions from the surface of the cymbal. When the cymbal is parallel to the floor more of the sound is sent vertically from the larger horizontal surface as compared to the small vertical surface. However, cymbals typically have several curves in their surfaces which, among other things, help to ensure that sounds is sent in horizontal directions as well. One benefit of the shields herein is to reflect the sound back toward the cymbal and away from an audience or a microphone. By adjusting the various holes and the shape and length of the side wall, the amount of reflection and the direction of the sound may be controlled. The shields may be designed specifically only to reflect sound away from microphones that are in some fixed position or direction with respect to the cymbal.

A further benefit is to absorb some of the sound. The shields may be made of any of a variety of different materials. Acrylics are inexpensive, are good reflectors, and also absorb some sound. As a result, some of the sound is reflected back toward the percussionist but some of the sound is absorbed by the acrylic material. Other materials may be used to obtain a particular sound absorbing characteristic. Using the acoustic material and the dampers, selected frequency bands are attenuated as they are absorbed by the acoustic material and also by the dampers. Typically this may be used to reduce the very high frequencies that make cymbals seem loud or that cause the most objectionable feedback but the amplitudes of other frequencies may also be moderated using the multiple techniques herein while also maintaining a natural cymbal sound.

When not handled well, cymbals and some other percussion instruments can produce ear-piercing sounds. The higher frequencies of cymbals generally give off the impression or irritation of cymbals being too loud or overbearing. The described damper crushes and absorbs some of these frequencies to allow a more natural sound to still emit from the cymbal while giving everyone a less piercing sound from the cymbal. In some cases, the sound reduction reduces the ear damage that can be caused by these frequencies at very high volumes.

During tests, the illustrated and described damper cuts volume by 4 to 8 dBA depending on the size of the cymbal, while also reducing the sound at frequencies starting around 300 to 1,000 Hz and more noticeably between 3,000 to 16,000 Hz. These are the pitches at which many people find that the cymbal causes a ringing in the ears or feels piercing. The shield was able to reduce sound volume by an average of 7 to 9 dBA, while also reducing frequencies starting around 25 to 50 Hz, 750 to 1,500 Hz, and most noticeably from 1,500 to 16,000 Hz. Combining the damper and the shield results in an average cut volume of 9 to 11 dBA depending on the size of the cymbal, while also reducing frequencies starting around 25 to 50 Hz, 500 to 1,500 Hz, and most noticeably from 1,500 to 16,000 Hz.

One benefit of the described shields and dampers is that the percussionist is no longer isolated behind walls and detached from the rest of the performers. The percussionist is also no longer in a cage of echoes of sound coming off of the acrylic panels. The described shields and dampers are also more visually attractive than the eyesore of the bulky acrylic panels.

A lesser or more equipped shield and damper than the examples described above may be desirable for certain implementations. Therefore, the configuration of the system and the particular components used in combination will vary from implementation to implementation depending upon numerous factors, such as price constraints, performance requirements, technological improvements, and/or other circumstances.

The present description presents the examples using particular terms, such as shield, wall, plate, container, tension rod, lug, damper, dampening, etc. These terms are used to provide consistent, clear examples, however, the present invention is not limited to any particular terminology. Similar ideas, principles, methods, apparatus, and systems can be developed using different terminology in whole, or in part. In addition, the present invention can be applied to ideas, principles, methods, apparatus, and systems that are developed around different usage models and hardware configurations.

In the present description, for the purposes of explanation, numerous specific details are set forth in order to provide a thorough understanding of the present invention. However, the present invention can be practiced without some of these specific details. In other instances, well-known structures and devices are shown in block diagram form. The specific detail can be supplied by one of average skill in the art as appropriate for any particular implementation.

Although this disclosure describes illustrative embodiments of the invention in detail, it is to be understood that the invention is not limited to the precise embodiments described. The specification and drawings are, accordingly, to be regarded in an illustrative rather than a restrictive sense. Various adaptations, modifications and alterations may be practiced within the scope of the invention defined by the appended claims.

In some embodiments, the invention includes an acoustic shield for a cymbal comprising: a side wall surrounding a portion of the edge of the cymbal to reflect sound back toward the cymbal. The shield may be on a side of the cymbal opposite a percussionist to reflect sound toward the percussionist. The shield may include a top plate over the side wall and over the cymbal, the top plate having a fixture to attach to a cymbal stand. The shield may include a bottom plate over the side wall and over the cymbal, the bottom plate having a fixture to attach to a cymbal stand. The bottom plate may have a central opening to allow a cymbal stand to extend through the bottom plate. The shield may include one or more grooves extending from the central opening.

The top plate may have a central opening to allow a cymbal stand to extend through the top plate. The top plate or the bottom plate or both may have holes through the respective plate to allow sound to propagate through the holes of the top or bottom plate. The side wall may be attached to the top plate on one edge of the side wall and to the bottom plate on an opposite edge. The top and bottom plate may have respective grooves and the side wall is inserted into the grooves and attached thereby.

The shield may include lugs on the top and the bottom plate and a tension rod connected to and between the top and bottom plate lugs respectively. The shield may include acoustic damping material inside the container on one or more of the top or bottom plate or the side walls. The shield may include a damper attached to a cymbal stand having fingers extending away from the cymbal stand to contact the cymbal. The fingers may be coated with a dampening material.

A cymbal and stand may include the shield in any of the variations described above. A drum set with a cymbal mounted to a cymbal stand may include the shield in any of the variations described above.

In some embodiments, the invention may be an apparatus that includes means for reflecting sound from a cymbal away from an audience, the means having a wall around the periphery of a portion of a cymbal. The apparatus may include means above and below the wall for reflecting sound above and below the cymbal, respectively for reflecting sound from the cymbal toward the cymbal. The apparatus may also include means for absorbing sound between the cymbal and any one of the reflecting means.

In some embodiments, the invention may be a damper that includes a fixture configured to be attached to a cymbal stand and a finger, such as a steel wire, extending away from the fixture and an attached cymbal stand to contact a cymbal mounted to the cymbal stand.

The finger may be coated with a dampening material, such as one configured to absorb resonant vibrations of the fingers, for example an elastomeric acoustic dampening material. The dampening material may be only near a tip of each finger opposite the fixture and configured to physically contact the cymbal or it may be over the finger from the fixture to a tip of each finger opposite the fixture.

There may be additional fingers and the fingers may be curved through an arc that starts at the fixture to the tip, the tip being at the same position in the arc for each finger. In some cases, the arc is in a vertical plane and the fingers are each also curved through an arc in a horizontal plane.

The finger can configured to contact the top of the cymbal each at a tip opposite the fixture. Alternatively, the finger may be configured to contact the bottom of the cymbal at the outer edge of the bell and extend outward from the fixture past the contact.

The fixture in some embodiments has a hole for each finger and the fingers pass through the hole and are secured in place in the hole. The ring may have a protrusion from the outer surface of the ring for each finger, wherein each finger is held by respective protrusion. The fixture may be in the shape of a ring configured to encircle the cymbal stand with the holes being through the ring.

Considered another way, the damper includes means for contacting a cymbal at a plurality of locations to dampen sound from the cymbal and means for attaching the means for contacting to a cymbal stand that carries the cymbal. The means for contacting may be configured to contact the cymbal in a ride area of the cymbal, inside the bell of the cymbal or in a different location.

What is claimed is:

1. A damper comprising:

a fixture in the shape of a ring configured to be attached to and encircle a cymbal stand when attached;

a plurality of resilient fingers in the form of flexible wires extending away from the fixture and the attached cymbal stand, to each resiliently, physically, in the form of the flexible wires, contact a different position on a surface of a cymbal mounted to the cymbal stand and to absorb vibrations of the cymbal, such that the fingers recover physical contact with the cymbal after the cymbal is moved by striking the cymbal; and a dampening material that is at least partially coating the fingers and configured to absorb vibrations of the fingers.

2. The damper of claim 1, wherein the dampening material fully coats the fingers.

3. The damper of claim 1, wherein the dampening material is configured to absorb resonant vibrations of the fingers that exceed the high range of human hearing.

4. The damper of claim 1, wherein the dampening material is an elastomeric acoustic dampening material.

5. The damper of claim 1, wherein the dampening material is only near a tip of each finger opposite the fixture and configured to physically contact the cymbal.

6. The damper of claim 1, wherein the dampening material is over the finger from the fixture to a tip of each finger opposite the fixture.

7. The damper of claim 1, wherein the fingers are each curved through an arc that starts at the fixture to the tip, the tip being at the same position in the arc for each finger.

8. The damper of claim 7, wherein the arc is in a vertical plane and wherein the fingers are each also curved through an arc in a horizontal plane.

9. The damper of claim 1, wherein the fingers comprise three fingers.

10. The damper of claim 1, wherein the fingers are configured to contact the top of the cymbal each at a tip opposite the fixture.

11. The damper of claim 1, wherein the fingers are configured to contact the bottom of the cymbal at the outer edge of a central bell of the cymbal and extend outward from the fixture past the outer edge of the bell.

12. The damper of claim 1, wherein the fingers comprise steel wires.

13. The damper of claim 12, wherein the fixture has a hole for each finger and wherein the fingers pass through the hole and are secured in place in the hole.

14. The damper of claim 13, wherein the fixture comprises a ring configured to encircle the cymbal stand, the holes being through the ring.

15. The damper of claim 12, wherein the fixture comprises a ring configured to encircle the cymbal stand and a protrusion from the outer surface of the ring for each finger, wherein each finger is held by respective protrusion.

16. The damper of claim 1, wherein the fixture is configured to slide vertically on the cymbal stand above the cymbal such that the weight of the fixture presses the fingers against the cymbal.

17. A damper comprising:

means for resiliently, physically, in the form of flexible wires, contacting a cymbal at a plurality of locations to dampen sound from the cymbal by absorbing vibrations of the cymbal, the means for contacting recovering physical contact with the cymbal after the cymbal is moved by striking the cymbal, wherein the means for contacting are at least partially coated with a dampening material that is configured to absorb vibrations of the means for contacting; and means in the shape of a ring for attaching the means for contacting to a cymbal stand and encircling the cymbal stand that carries the cymbal.

18. The damper of claim 17, wherein the means for contacting are configured to contact the cymbal in a ride area of the cymbal.

19. A cymbal system comprising:

a cymbal;

a cymbal stand configured to carry the cymbal;

a fixture in the shape of a ring configured to be attached to and encircle a cymbal stand when attached;

a plurality of resilient fingers in the form of flexible wires extending away from the fixture and the attached cymbal stand, to each resiliently, physically, in the form of the flexible wires, contact a different position on a surface of a cymbal mounted to the cymbal stand and to absorb vibrations of the cymbal, such that the fingers recover physical contact with the cymbal after the cymbal is moved by striking the cymbal; and a dampening material that is at least partially coating the fingers and configured to absorb vibrations of the fingers.

20. The cymbal system of claim 19 further comprising an elastomeric damping material along the length of each finger from the fixture to a tip opposite the fixture.

* * * * *